US011566762B1

(12) United States Patent
Li

(10) Patent No.: US 11,566,762 B1
(45) Date of Patent: Jan. 31, 2023

(54) SOCKET WITH NIGHT LIGHT FUNCTION

(71) Applicant: Tonghua Intelligent Technology Co., Ltd, Dongguan (CN)

(72) Inventor: Zhijin Li, Dongguan (CN)

(73) Assignee: TONGHUA INTELLIGENT TECHNOLOGY CO., LTD, Dongguan (CN)

( * ) Notice: Subject to any disclaimer, the term of this patent is extended or adjusted under 35 U.S.C. 154(b) by 0 days.

(21) Appl. No.: 17/672,630

(22) Filed: Feb. 15, 2022

(30) Foreign Application Priority Data

Jan. 13, 2022 (CN) ..... 202220092419.4

(51) Int. Cl.

| | |
|---|---|
| ***F21S 8/00*** | (2006.01) |
| ***F21V 23/06*** | (2006.01) |
| ***F21V 37/00*** | (2006.01) |
| ***F21V 23/04*** | (2006.01) |

(52) U.S. Cl.
CPC ..... *F21S 8/035* (2013.01); *F21V 23/0485* (2013.01); *F21V 23/06* (2013.01); *F21V 37/0095* (2013.01)

(58) Field of Classification Search
CPC ..... F21V 8/035; F21V 23/0485; F21V 23/06; F21V 37/0095; H01R 13/6658; H01R 13/3333; H01R 13/717–7175
See application file for complete search history.

(56) References Cited

U.S. PATENT DOCUMENTS

| | | | | |
|---|---|---|---|---|
| 11,333,345 | B1 * | 5/2022 | Chen | F21V 33/0004 |
| 2013/0107041 | A1 * | 5/2013 | Norem | H04N 5/23206 348/169 |
| 2019/0089104 | A1 * | 3/2019 | O'Reilly | H01R 13/7175 |
| 2019/0195445 | A1 * | 6/2019 | Chien | H01R 33/92 |
| 2021/0028585 | A1 * | 1/2021 | O'Reilly | F21S 8/035 |

* cited by examiner

*Primary Examiner* — Anabel Ton
(74) *Attorney, Agent, or Firm* — Andrew C. Cheng

(57) ABSTRACT

A socket with a night light function includes a housing, a connecting unit and a light emitting unit. The housing includes a base, a transmitting light member and a cover. The transmitting light member is sandwiched between the base and the cover. The connecting unit is disposed in the housing and is electrically connected to a plug. The light emitting unit includes a light emitting element disposed in the base, a photosensitive switch, a touch switch and a controller. The light emitting element, the photosensitive switch and the touch switch are all in signal connection with the controller. The photosensitive switch collaborates with the touch switch to control the operation of the light emitting element; the light intensity around the socket is increased by means of the light emitting element and the transmitting light member. The socket is convenient to use and has multiple functions.

10 Claims, 4 Drawing Sheets

SOCKET WITH NIGHT LIGHT FUNCTION

FIELD

The invention relates to the technical field of household appliances, in particular to a socket with a night light function.

BACKGROUND

Power sockets are indispensable in daily life and offices, and various wires can be plugged into the power sockets to be connected to other circuits. The wires are connected or disconnected with copper elements to close or open these circuits.

At present, the sockets have single function, thus being unable to meet user requirements and inconvenient to use.

SUMMARY

In view of the above-mentioned problems, it is desired to provide a socket with a night light function, which is convenient to use and has multiple functions.

A socket with a night light function comprises a housing, a connecting unit and a light emitting unit, wherein the housing comprises a base, a transmitting light member and a cover; the transmitting light member has an end surface abutting against the base and an end surface abutting against the cover; the connecting unit is disposed in the housing and is electrically connected to a plug; the light emitting unit comprises a light emitting element, a photosensitive switch, a touch switch and a controller; the light emitting element is disposed in the base and corresponds to the transmitting light member; and the light emitting element, the photosensitive switch and the touch switch are all in signal connection with the controller.

In one embodiment, the connecting unit comprises a lightning-proof board, a body, a pin and multiple conductive elements, wherein the lightning-proof board is installed on the base, the body is installed on the lightning-proof board, the pin penetrates through the base, the lightning-proof board and the body, the conductive elements are installed in the body and are electrically connected to the pin, and the conductive elements are electrically connected to the lightning-proof board.

In one embodiment, the base comprises a bottom plate, multiple supporting portions and multiple positioning portions, wherein the supporting portions protrude from the bottom plate and are used to support the bottom of the body, and the positioning portions protrude from the bottom plate.

In one embodiment, the base further comprises a guide portion which protrudes from the bottom plate, and the guide portion is configured to be plugged into an external power socket/source; and the housing further comprises a fastener used to fix the cover, the base and the external power socket.

In one embodiment, the cover comprises a shell, multiple limit portions, multiple support legs and multiple fixing portions, wherein the limit portions are installed in the shell and are used to fix a side wall of the bodies of the connecting unit, the support legs are inserted into the positioning portions and are in one-to-one correspondence with the positioning portions, and the fixing portions are disposed on an inner wall of the shell.

In one embodiment, the socket with a night light function further comprises a charging unit, wherein the charging unit comprises a charging PCB, a control PCB and a first charging port, and the charging PCB is electrically connected to the lightning-proof board; the charging PCB has a side abutting against the positioning portions and a side abutting against the fixing portions; and the control PCB is electrically connected to the charging PCB, and the first charging port, the photosensitive switch and the touch switch are all electrically connected to the control PCB.

In one embodiment, the charging unit further comprises an indicator light, and the indicator light is disposed on a side of the first charging port and is electrically connected to the control PCB.

In one embodiment, the charging unit further comprises a second charging port electrically connected to the control PCB.

In one embodiment, the second charging port is a USB-C charging port, and the first charging port is a USB-A charging port.

In one embodiment, the transmitting light member comprises a base plate and multiple hook portions connected to the base plate, and the hook portions are used to fix the light emitting element.

Compared with the prior art, the invention has the following beneficial effects:

According to the socket with a night light function, the photosensitive switch collaborates with the touch switch to control the operation of the light emitting element, such that the socket is convenient to use, the light intensity around the socket is increased by means of the light emitting element and the transmitting light member, such that a night light effect is realized; and the socket with a night light function is convenient to use and has multiple functions.

DESCRIPTION OF THE EMBODIMENTS

Figure 1:
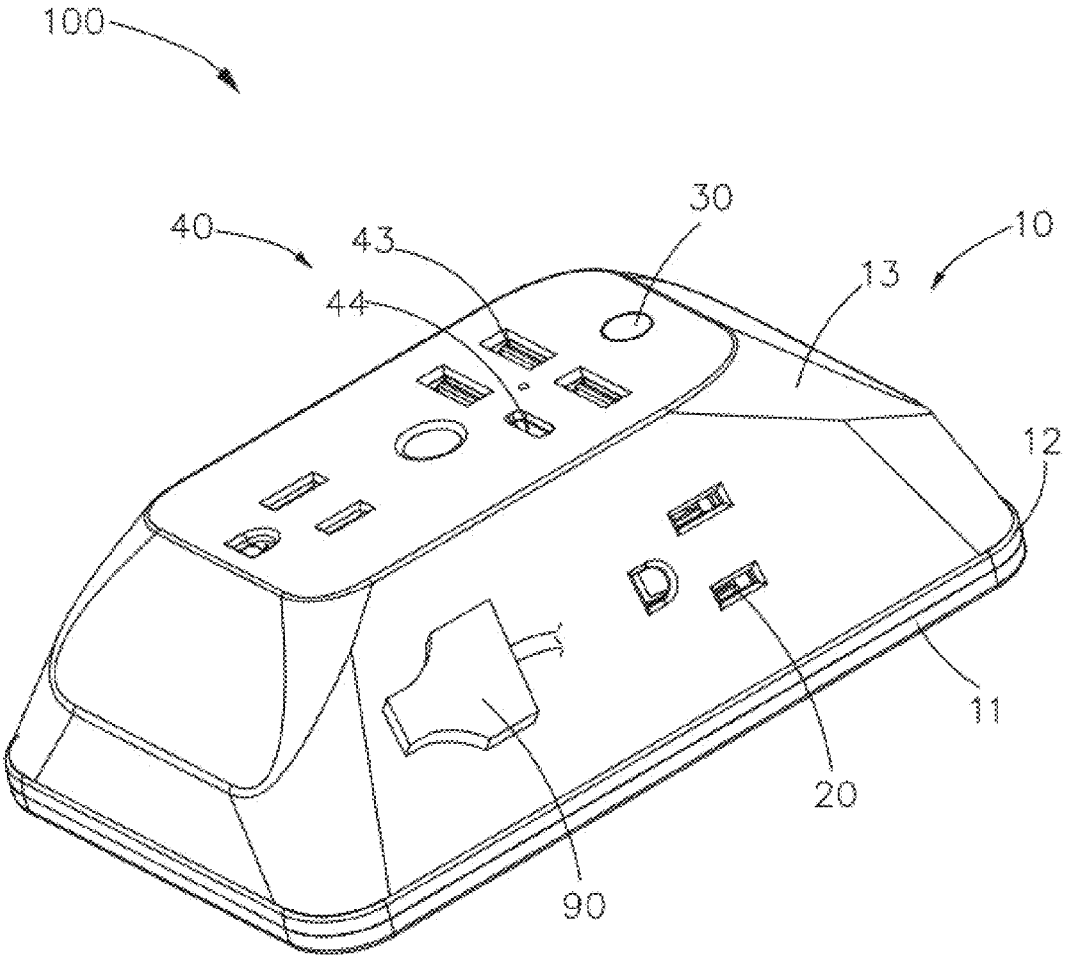
FIG. 1 is an assembled structural view of a socket with a night light function according to one preferred embodiment of the invention.

For a good understanding of the invention, the invention will be described more comprehensively below. Clearly, the invention may be implemented in different forms, and is not limited to the embodiments described in this specification. In fact, these embodiments are provided for the purpose of a more thorough and comprehensive understanding of the disclosure of the invention.

Referring to FIG. 1 to FIG. 4, a socket 100 with a night light function according to an embodiment of the invention comprises a housing 10, a connecting unit 20 and a light emitting unit 30. The housing 10 comprises a base 11, a transmitting light member 12 and a cover 13, and the light emitting unit 30 comprises a light emitting element 31, a photosensitive switch 32, a touch switch 33 and a controller (not shown). In the socket 100 with a night light function of the present invention, the photosensitive switch 32 cooperates with the touch switch 33 to control the operation of the light emitting element 31, such that the socket is convenient to use; and the light intensity around the socket is increased by means of the light emitting element 31 and the transmitting light member 12, such that a night light effect is realized.

Figure 2:
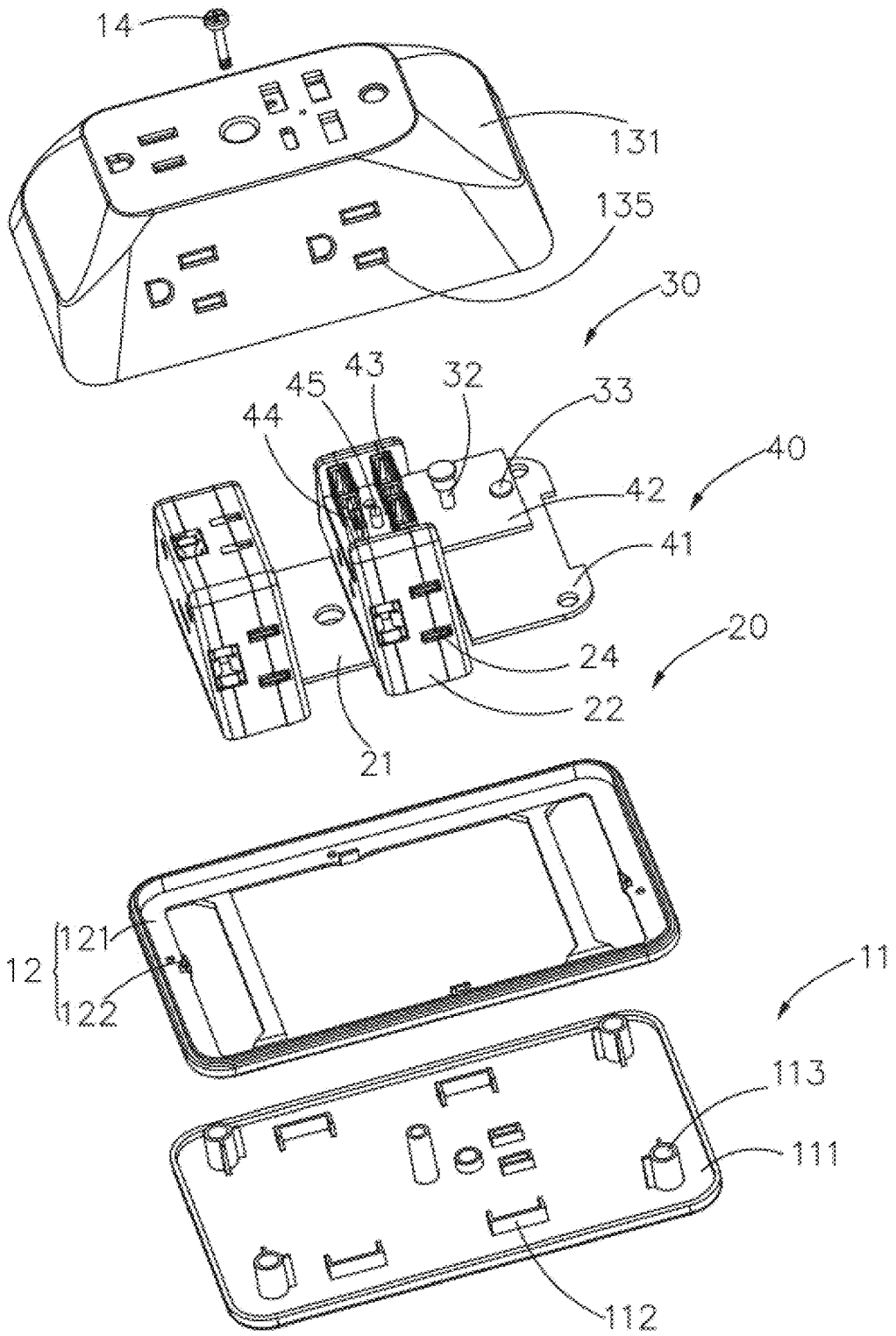
FIG. 2 is an exploded view of the socket with a night light function in FIG. 1.
Figure 3:
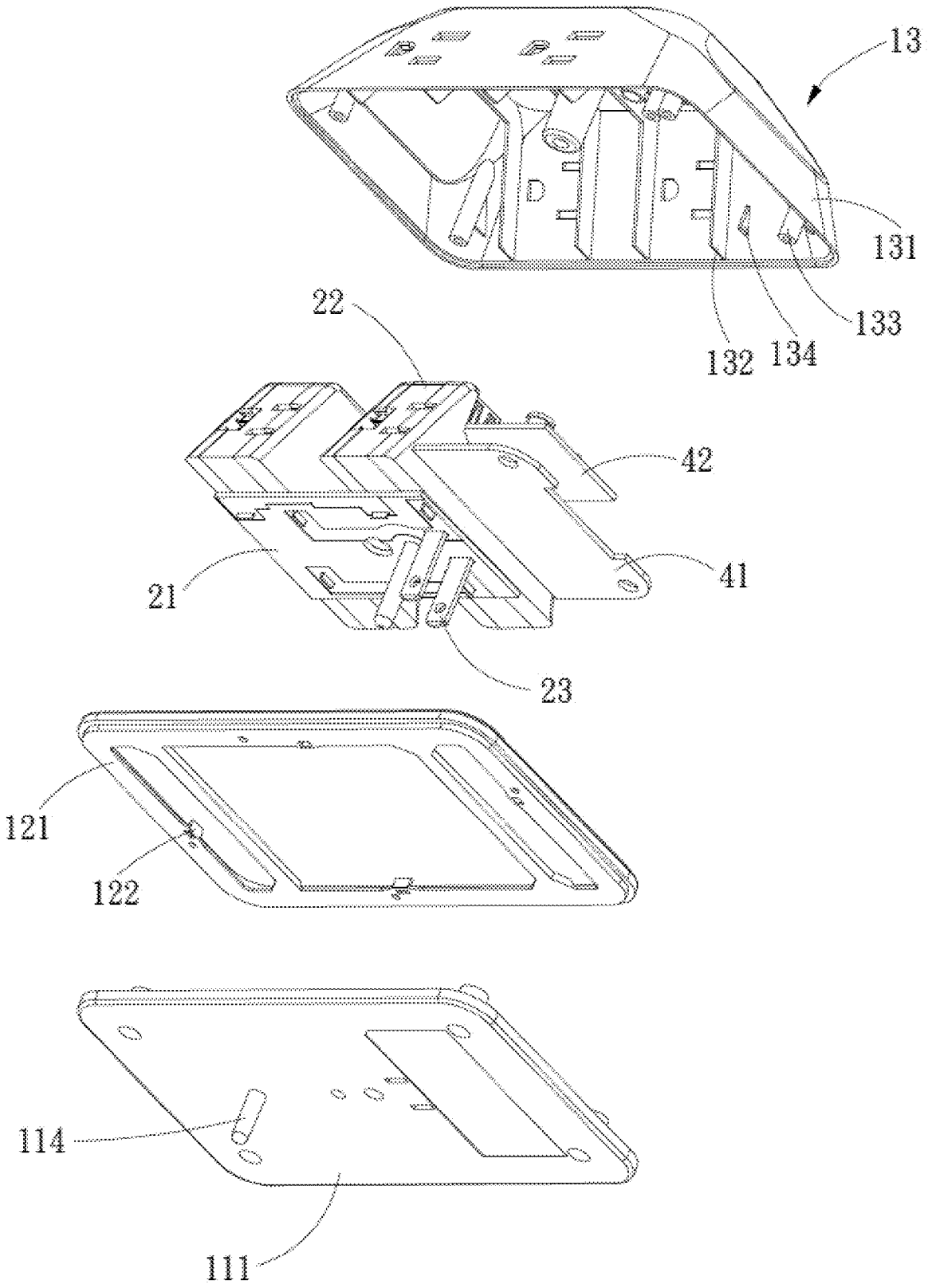
FIG. 3 is similar to FIG. 2 but viewed from another perspective.

As shown in FIG. 1 to FIG. 3, in this embodiment, the housing 10 comprises the base 11, the transmitting light member 12 and the cover 13. One end of the transmitting light member 12 abuts against the base 11, and the other end of the transmitting light member 12 abuts against the cover 13. Optionally, the base 11 and the cover 13 are made of a semi-transmitting material or a light-proof material. The base 11 comprises a bottom plate 111, multiple supporting portions 112 and multiple positioning portions 113. The supporting portions 112 protrude from the bottom plate 111 in a direction toward the connecting unit 20 and are configured to support the bottom of the connecting unit 20, and the positioning portions 113 protrude from the bottom plate 111. Further, the number of the supporting portions 112 is four, and the four supporting portions 112 are arranged in pairs, and the number of the positioning portions 113 is four, and the four positioning portions 113 protrude from four corners of the bottom plate 111 respectively. The base 11 further comprises a guide portion 114 protruding from the bottom plate 111 in a direction away from the connecting unit 20, and the guide portion 114 is configured to be plugged into an external power socket. When the external power socket is an American wall socket, the guide portion 114 can be plugged into a jack of the wall socket to form a firm assembly.

Referring to FIG. 2 and FIG. 3 again, the transmitting light member 12 comprises a base plate 121 and multiple hook portions 122 arranged on the base plate 121, wherein the base plate 121 is connected to the bottom plate 111, and the hook portions 122 are configured to fix the light emitting unit 30 to the base plate 121. In some embodiments, the cover 13 comprises a shell 131, multiple limit portions 132, multiple support legs 133 and multiple fixing portions 134. The shell 131 is connected to the base plate 121 and is formed with multiple jacks 135 allowing plugs 90 (shown in FIG. 1) to be plugged therein. The limit portions 132 are arranged in the shell 131 and are fixedly connected to an outer/top side of the connecting unit 20. Optionally, the number of the limit portions 132 is four, and the four limit portions 132 are arranged in pairs. The support legs 133 are configured to be inserted into the positioning portions 113 and are in one-to-one correspondence with the positioning portions 113. The fixing portions 134 are disposed on an inner wall of the shell 131. In some embodiments, the housing 10 further comprises a fastener 14 for fixing the cover 13, the base 11 and the external power socket together. When the socket of the external power source is an American wall socket, the fastener 14 is connected to the socket of the external power source in a threaded manner to form a firm assembly. Optionally, the fastener 14 is a screw.

As shown in FIG. 2 and FIG. 3, the connecting unit 20 is disposed in the housing 10 and is electrically connected to a plug. The connecting unit 20 comprises a lightning-proof board 21, bodies 22, pins 23 and multiple conductive elements 24. The lightning-proof board 21 is installed on the base 11; the bodies 22 are installed on the lightning-proof board 21, the supporting portions 112 are used to support the bottoms of the bodies 22, and the limit portions 132 are used to fix/position side walls of the bodies 22. Optionally, the bodies 22 are formed with through holes (not shown) corresponding to the jacks. Further, the number of the bodies 22 is two, and the conductive elements 24 of the two bodies 22 are electrically connected to each other through the lightning-proof board 21. The pins 23 penetrate through the base 11, the lightning-proof board 21 and the bodies 22, and are configured to be plugged into the external power socket. The conductive elements 24 are installed in the bodies 22, and electrically connected to the pins 23 and the lightning-proof board 21. The conductive elements 24 are arranged corresponding to the through holes.

Figure 4:
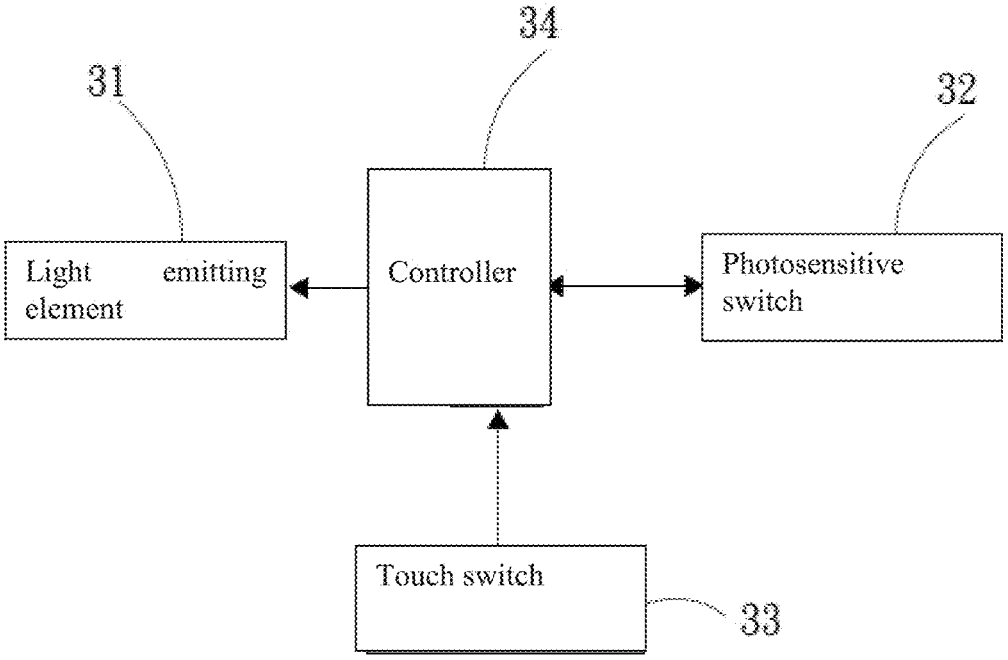
FIG. 4 is a principle diagram of a light emitting unit of the socket with a night light function in FIG. 1.

As shown in FIG. 3 and FIG. 4, in order to fulfil a night light function, the light emitting unit 30 comprises a light emitting element 31, a photosensitive switch 32, a touch switch 33 and a controller 34. The light emitting element 31 is disposed in the base 11 and corresponds to the transmitting light member 12; optionally, the hook portions 122 are used to fix the light emitting element 31, and the light emitting element 31 can be an LED light strip. The light emitting element 31, the photosensitive switch 32 and the touch switch 33 are all in signal connection with the controller 34, such that automatic control is realized. When the socket is used, the photosensitive switch 32 collects the light intensity value of an ambient environment and transmits the collected light intensity value to the controller 34, and the controller 34 compares the light intensity value with a preset value. When the collected light intensity value is lower than the pre-set value, the controller 34 controls the light emitting element 31 to start/turn on. When lighting is not needed, the light emitting element 31 is turned off by means of the touch switch 33; and when lighting is needed again, the touch switch 33 is triggered to start the light emitting element 31 again. In addition, after the light emitting element 31 is turned off by means of the touch switch 33, the touch switch 33 needs to be triggered in order to turn on the photosensitive switch 32 again.

As shown in FIG. 2, to fulfil different functions, the socket 100 with a night light function further comprises a charging unit 40 which comprises a charging PCB 41, a control PCB 42 and first charging ports 43. The charging PCB 41 is electrically connected to the lightning-proof board 21. One side of the charging PCB 41 abuts against the positioning portions 113, and the other side of the charging PCB 41 abuts against the fixing portions 134. That is, the charging PCB 41 is sandwiched between the positioning portions 113 of the base 11 and the fixing portions 134 of the cover 13. The control PCB 42 is electrically connected to the charging PCB 41, and the first charging ports 43, the photosensitive switch 32 and the touch switch 33 are all electrically connected to the control PCB 42. Optionally, the number of the first charging ports 43 is three; and the first charging ports 43 are USB-A charging ports. Further, the charging unit 40 further comprises second charging ports 44, and the second charging ports 44 are electrically connected to the control PCB 42; and optionally, the second charging ports 44 are USB-C charging ports. The charging unit 40 further comprises an indicator light 45, and the indicator light 45 is disposed on one side of the first charging ports 43 and is electrically connected to the control PCB 42. The indicator light 45 lights up when powered on.

When the socket is used, the pins 23 are electrically connected to the external power source, then one plug 90 of an electronic device is inserted into one of the jacks 135 to be electrically connected to the conductive elements 24. Charging for electronic devices can be realized by means of the first charging ports 43 and the second charging ports 44 receiving charging cables/wires of the electronic devices. The light emitting element 31 can be automatically turned on or off by means of the photosensitive switch 32. After the photosensitive switch 32 controls the light emitting element 31 to start, the light emitting element 31 is manually controlled to be turned off or be tuned on again by means of the touch switch 33; and the light intensity around the socket is increased by means of the light emitting element 31 and the transmitting light member 12, such that a night light effect is realized, and the socket is convenient to use.

According to the socket 100 with a night light function of the present invention, the photosensitive switch 32 collaborates with the touch switch 33 to control the operation of the light emitting element 31, such that the socket is convenient to use; the light intensity around the socket is increased by means of the light emitting element 31 and the transmitting light member 12, such that a night light effect is realized; and the socket 100 with a night light function is convenient to use and has multiple functions.

The above embodiments only illustrate several implementations of the invention, and are specifically described in detail, but these embodiments should not be understood as limiting the scope of the patent of invention. It should be noted that those ordinarily skilled in the art can make different transformations and improvements without departing from the concept of the invention, and all these transformations and improvements should also fall within the protection scope of the invention. Thus, the protection scope of the invention should be defined by the appended claims.

What is claimed is:

1. A socket with a night light function, comprising a housing, a connecting unit and a light emitting unit, wherein the housing comprises a base, a transmitting light member and a cover; the transmitting light member has an end surface abutting against the base and another end surface abutting against the cover;

wherein the connecting unit is disposed in the housing and is configured to be electrically connected to a plug;

wherein the light emitting unit comprises a light emitting element, a photosensitive switch, a touch switch and a controller; the light emitting element is disposed in the base and corresponds to the transmitting light member; and the light emitting element, the photosensitive switch and the touch switch are all in signal connection with the controller; and wherein the connecting unit comprises a lightning-protection board, a body, a pin and multiple conductive elements;

the lightning-protection board is installed on the base;

the body is installed on the lightning-protection board;

the pin penetrates through the base, the lightning-protection board and the support; and the conductive elements are installed in the support, and are electrically connected to the pin and the lightning-protection board.

2. The socket with a night light function according to claim 1, wherein the base comprises a bottom plate, multiple supporting portions and multiple positioning portions, the supporting portions protrude from the bottom plate and are configured to support a bottom of the body of the connecting unit, and the positioning portions protrude from the bottom plate.

3. The socket with a night light function according to claim 2, wherein the base further comprises a guide portion which protrudes from the bottom plate, and the guide portion is configured to plugged into an external power socket; and the housing further comprises a fastener configured to fix the cover, the base and the external power socket.

4. The socket with a night light function according to claim 2, wherein the cover comprises a shell, multiple limit portions, multiple support legs and multiple fixing portions, the limit portions are arranged in the shell and are configured to fix a side wall of the body of the connecting unit, the support legs are inserted into the positioning portions and are in one-to-one correspondence with the positioning portions, and the fixing portions are disposed on an inner wall of the shell.

5. The socket with a night light function according to claim 4, further comprising a charging unit which comprises a charging PCB, a control PCB and a first charging port;

wherein the charging PCB is electrically connected to the lightning-protection board;

the charging PCB has a side abutting against the positioning portions and a side abutting against the fixing portions;

the control PCB is electrically connected to the charging PCB; and the first charging port, the photosensitive switch and the touch switch are all electrically connected to the control PCB.

6. The socket with a night light function according to claim 5, wherein the charging unit further comprises an indicator light, and the indicator light is disposed on a side of the first charging port and is electrically connected to the control PCB.

7. The socket with a night light function according to claim 5, wherein the charging unit further comprises a second charging port electrically connected to the control PCB.

8. The socket with a night light function according to claim 7, wherein the second charging port is a USB-C charging port, and the first charging port is a USB-A charging port.

9. The socket with a night light function according to claim 1, wherein the transmitting light member comprises a base plate and multiple hook portions connected to the base plate, and the hook portions are configured to fix the light emitting element.

10. A socket with a night light function, comprising a housing, a connecting unit and a light emitting unit, wherein the housing comprises a base, a transmitting light member and a cover; the transmitting light member has an end surface abutting against the base and another end surface abutting against the cover;

wherein the connecting unit is disposed in the housing and is configured to be electrically connected to a plug;

wherein the light emitting unit comprises a light emitting element, a photosensitive switch, a touch switch and a controller; the light emitting element is disposed in the base and corresponds to the transmitting light member; and the light emitting element, the photosensitive switch and the touch switch are all in signal connection with the controller; and wherein the transmitting light member comprises a base plate and multiple hook portions connected to the base plate, and the hook portions are configured to fix the light emitting element.

* * * * *